United States Patent [19]

Morrocco

[11] Patent Number: 4,714,190

[45] Date of Patent: Dec. 22, 1987

[54] FAST FOOD TAKE OUT CARTON WITH COVER

[76] Inventor: Diane M. Morrocco, 71 Haviland St., Bristol, Conn. 06010

[21] Appl. No.: 905,955

[22] Filed: Sep. 11, 1986

[51] Int. Cl.[4] ..... B65D 5/34

[52] U.S. Cl. ..... 229/1.5 B; 229/126; 229/125; 229/112; 229/904; 229/903; 220/339; 220/335; 220/315; 294/55

[58] Field of Search ..... 229/1.5 B, 185, 164, 229/41 C, 44 R, 124, 126, 160, 172, 45 R, 16 A, 125, 131; 383/33; D7/104; 294/55

[56] References Cited

U.S. PATENT DOCUMENTS 306,406 10/1884 Lane ..... 229/126

3,809,310 5/1974 VanderLugt, Jr. ..... 229/164

4,185,764 1/1980 Cote ..... 229/1.5 B

*Primary Examiner*—Willis Little

*Attorney, Agent, or Firm*—CTC & Associates

[57] ABSTRACT

A scoop-type carton of thermal insulating material for containing fast food items such as French fries and keeping them hot has a body portion comprising a bottom and side panels upstanding and tapered outwardly from the bottom. The carton also has a cover that is integrally hinged to one of the side panels and is selectively movable between an open position and a closed position in which the cover covers the open end. The cover is releasably held in the closed position by interengagement of the cover and a side panel remote from the side panel to which the cover is integrally hinged.

7 Claims, 3 Drawing Figures

FAST FOOD TAKE OUT CARTON WITH COVER

BACKGROUND OF THE INVENTION

This invention relates to a container for food items, such as French fries, which are commonly scooped out of a storage receptacle by means of and into a carton that is placed in a bag that is then carried from the fast food restaurant by the customer.

Such cartons as have been previously used for this purpose have had no covers, with the result that the fries rapidly get cold and commonly fall out of the carton and find their way into the bottom of the bag, and are thereupon wasted or quickly become cold and/or the customer gets aggravated.

It is an important object of the invention to provide an improved scoop type carton for French fries, the improved carton having a cover that insures that the French fries stay in the carton.

It is a further object to provide such an improved carton that will keep the French fries hotter for longer periods of time.

It is yet another object of the invention to provide such an improved carton in which the French fries can be reheated at home, should the customer so desire.

It is still another object to provide such a carton that costs little, if any, more than cartons heretofore in use.

Other objects and advantages will appear hereinafter.

A patentability search hereon revealed the following U.S. Patents:

| U.S. Pat. No. | Date | Inventor |
|---|---|---|
| 3,630,430 | December 28, 1971 | Struble |
| 3,877,632 | April 15, 1975 | Steel |
| 4,185,764 | January 29, 1980 | Cote |
| 4,267,955 | May 19, 1981 | Struble |
| 4,410,129 | October 18, 1983 | Wischusen, III |

Struble U.S. Pat. No. 3,630,430 discloses a scoop-type open ended carton that is stored flat and is capable of being transformed to three-dimensional scoop form with one hand.

Steel discloses scoop-type carton that has portions that provide legs when the carton is transformed from flat three-dimensional form. The legs permit the carton to be stood up. There is no cover.

Cote teaches a flat, folded carton, open at the top, and having a snap-up bottom for erection into a conical hollow container. The bottom is octagonal.

Struble U.S. Pat. No. 4,267,955 essentially teaches a modified blank layout for use in making the open ended carton of Struble '430, to maximize the number of cartons made per unit of material stock.

Wischusen, III discloses an open-ended collapsible paperboard container constructed from a minimal amount of paperboard.

These prior patents do not teach scoop type cartons with covers for fast food items, such as French fries.

SUMMARY OF THE INVENTION

A preferred scoop-type carton in accordance with the invention is made of suitable thermal insulating material such as polystyrene foam material. The carton has a body portion comprising a bottom and side panels upstanding from and tapering outwardly from the bottom and defining an open end remote from the bottom. The carton also has a cover and a hinge integrally connects the cover to one of the side panels. The cover is selectively movable between an open position in which French fries can be scooped into the open end of the body portion of the carton or removed therefrom, as by dumping, and a closed position in which the cover covers the open end and the French fries and heat therefrom will be retained within the carton. The cover is held in the closed position by interengagement of the cover and a side panel that is remote from that side panel to which the cover is hingedly connected.

DESCRIPTION OF THE INVENTION

Figure 1:
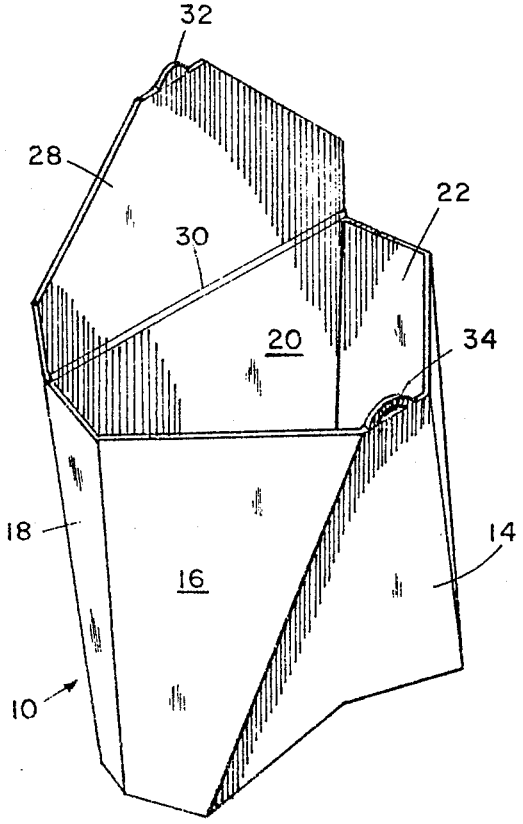
FIG. 1 is a perspective view of a preferred carton according to the invention.
Figure 2:
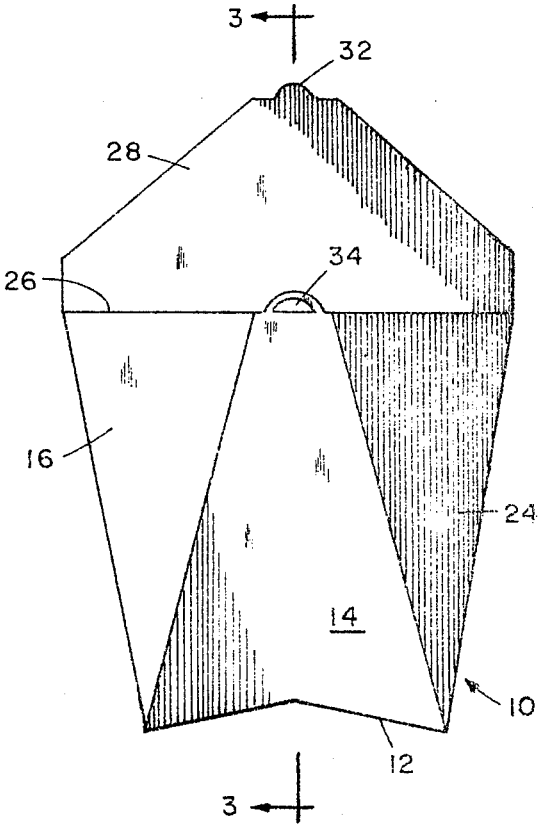
FIG. 2 is a front elevational view of the carton of FIG. 1.
Figure 3:
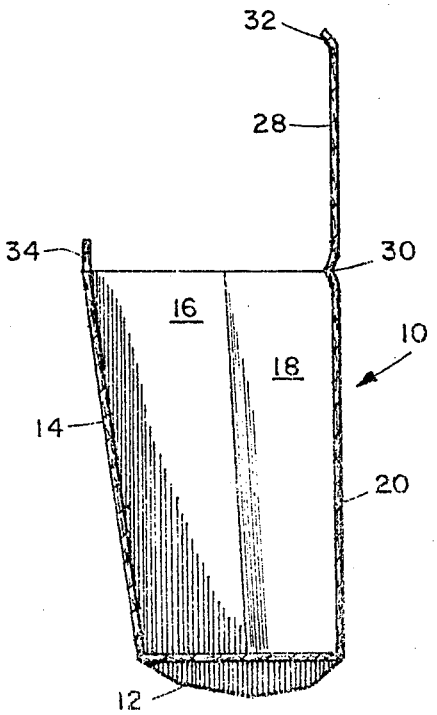
FIG. 3 is a sectional view taken on line 3—3 of FIG. 2.

The drawing shows a carton 10 that is a preferred embodiment of the invention. Carton 10 is molded of suitable material, preferably a thermal insulating variety such as polystyrene foam material, from which carton 10 can be molded.

Carton 10 is of one piece and comprises a body portion including a bottom 12 and side panels 14, 16, 18, 20, 22 and 24 upstanding and tapering outwardly from bottom 12 and defining a hexagonal open end 26 remote from bottom 12. Panel 20 is the largest side panel and panel 14 is opposite panel 20.

Carton 10 further includes a cover 28 that is integrally connected by a hinge 30 to the upper edge of panel 20 at open end 26. Cover 28 conforms in shape and size to open end 26, so that, when cover 28 is folded down, about hinge 30, to be flush with open end 26, cover 28 will cover open end 26.

Thus, cover 28 is movable between an open position in which it extends longitudinally from panel 20 as illustrated, and a closed position in which it is folded down to cover open end 26. Hinge 30 has a built-in bias tending to maintain cover 28 in, or move it to, its open position.

Cover 28 further comprises a tongue 32 protruding from the edge of cover 28 remote from hinge 30, and panel 14 is provided, at open end 26, with an eyelet 34, positioned and shaped to receive tongue 32 when cover 28 is moved to its closed position, thus to hold carton 10 closed.

It will be noted that open end 26, while hexagonal as mentioned, is not in the form of a regular hexagon. Instead, it is elongated, thus to facilitate scooping French fries into carton 10 through open end 26 in oriented fashion.

After carton 10 has been filled, carton 10 is closed by folding cover 28 down against the bias of hinge 30, and tongue 32 is brought into interengagement with eyelet 34.

Thus, hot French fries are in carton 10 and held therein by cover 28. Due to the thermal insulating properties of polystyrene foam material, the French fries will remain hot for a considerable period of time, and can even be reheated later on, without removal from carton 10.

Due to the fact that side panels 14, 16, 18, 20, 22 and 24 taper outwardly from bottom 12, cartons 10 are stackable one within another.

Carton 10 can alternatively be die cut from a suitable blank and glued together.

It is apparent that the invention attains the stated objects and advantages and others.

The disclosed details are not to be taken as limitations on the invention except as those details may be included in the appended claims.

What is claimed is:

1. A scoop-type carton for fast food items, said carton being of thermally insulating material and comprising a body portion including a bottom and side panels upstanding from said bottom, a cover and an integral hinge connecting said cover and one of said side panels at said open end, said cover conforming in size and shape to said open end, said cover being movable between an open position in which items can be scooped into said body portion and said cover extends longitudinally from said panel to which it is connected by said hinge and a closed position in which it is folded down to cover said open end, said hinge being biased to hold said cover normally longitudinally extending from said one of said side panels in said open position, and having a built-in bias tending to maintain said cover in, or return it to, said open position.

2. A carton according to claim 1 wherein said material is polystyrene foam material and said carton is molded of said foam material.

3. A carton according to claim 1 wherein said carton is of one-piece construction.

4. A carton according to claim 1 wherein said side panels taper outwardly from said bottom to said open end, whereby said carton is stackable with other similar cartons.

5. A carton according to claim 1 wherein said cover has a tongue at its edge remote from said hinge and one of said side panels remote from said side panel to which said cover is connected has an eyelet at said open end, said eyelet positioned and shaped to receive said tongue to hold said cover in interengagement therewith to hold said cover in to said closed position, against the bias of said hinge.

6. A carton according to claim 1 wherein said side panels are six in number, whereby said open end defines a hexagon.

7. A carton according to claim 6 wherein said hexagon is elongated.

* * * * *